United States Patent [19]

Crosley et al.

[11] Patent Number: 4,912,944

[45] Date of Patent: Apr. 3, 1990

[54] MAGNETIC JEWELRY

[76] Inventors: Dana B. Crosley, 6 Chatham Pl.; Jessica L. Cohn, 20 Allan Dr., both of White Plains, N.Y. 10605

[21] Appl. No.: 291,179

[22] Filed: Dec. 28, 1988

[51] Int. Cl.[4] ..... A44C 17/02

[52] U.S. Cl. ..... 63/29.2; 63/29.1; 132/275; 24/303

[58] Field of Search ..... 63/29.2, 29.1, 28, 30, 63/1.1, 2; 132/275, 276, 277, 278, 279; 24/303

[56] References Cited

U.S. PATENT DOCUMENTS

| | | | |
|---|---|---|---|
| 1,140,975 | 5/1915 | Frankel . | |
| 1,528,882 | 3/1925 | Kennerly . | |
| 2,361,772 | 10/1944 | Kaplan | 132/279 X |
| 2,659,169 | 11/1953 | Brennan . | |
| 2,661,748 | 12/1953 | Racho | 132/275 |
| 2,752,764 | 7/1956 | Lederer | 63/29.1 |
| 2,975,538 | 3/1961 | Murfin . | |
| 3,078,183 | 2/1963 | Karalus . | |
| 3,509,734 | 5/1970 | Lederer | 63/29.2 X |
| 3,533,247 | 10/1970 | Douglas | 63/29.1 X |
| 3,733,851 | 5/1973 | D'Apuzzo | 63/1.1 |
| 3,835,664 | 9/1974 | Nesbit . | |
| 4,195,492 | 4/1980 | Johnson | 63/29.2 X |

*Primary Examiner*—Laurie K. Cranmer

*Attorney, Agent, or Firm*—Varnum, Riddering, Schmidt & Howlett

[57] ABSTRACT

An article of jewelry comprising a base element which supports an ornamented substrate element thereon by magnetic attraction, both the base element and the substrate element having magnetically attractable properties and at least one of them having the properties of a permanent magnet, whereby the substrate element is interchangeable with other like elements bearing different ornamentation.

10 Claims, 1 Drawing Sheet

MAGNETIC JEWELRY

BACKGROUND OF THE INVENTION

This invention relates to jewelry; and more particularly, it relates to jewelry in which an ornamented substrate element is held by magnetic attraction in engagement with a base element adapted to be worn on the person, whereby the substrate element is readily interchangeable with other like elements bearing various ornamentation which differs from that of the first substrate element.

U.S. Pat. No. 2,659,169, issued Nov. 17, 1953 to R. F. Brennan, discloses magnetic means for attaching ornamental objects to a metal surface. Specifically, the magnetic means comprise permanent magnets carried by the object for limited movement relative thereto to permit the magnets to engage the metal surface directly.

U.S. Pat. No. 3,835,664, issued Sept. 17, 1974 to A. F. Nesbit, discloses s system of interchangeable shims which may be used to alter the effective diameter of a finger ring and which are held in engagement with the ring by magnetic attraction.

SUMMARY OF THE INVENTION

The present invention provides an article of jewelry comprising a base element adapted to be worn on the person, and a substrate element bearing ornamentation on the surface thereof. The opposite surface is unornamented, the base element having an outer support surface adapted to receive the substrate element in engagement with its unornamented surface. The base element and the substrate element have magnetically attractable properties and at least one of them has the properties of a permanent magnet, whereby the unornamented surface of the substrate element is held in removable engagement with the support surface of the base element by the force of magnetic attraction between base element and substrate element.

In preferred forms of the invention, the base element is formed of a relatively rigid ferrous material and the substrate element is formed of a flexible magnetized sheet material.

It is also preferred that the substrate element be interchangeable with other like substrate elements bearing ornamentation differing from the ornamentation borne on the first-mentioned substrate element. Such a base element and an assortment of such substrate elements may be packaged and sold in or as a set.

The ornamentation preferably comprises decorative means adhesively affixed to the said one surface of the substrate element, and may comprise one or more stones, decorative flexible sheet material, sequins, or combinations of these and other decorative ornamental objects.

The invention also provides a kit for forming articles of jewelry, the kit comprising at least one such base element, a supply of flexible sheet material having the properties of a permanent magnet, and a supply of decorative means. One of the opposed surfaces of the sheet material is coated with adhesive, and the other is free of adhesive. An article of jewelry may be formed by cutting the sheet material to provide at least one substrate element, affixing at least one of the decorative means to the adhesive-coated surface of the substrate element, and removably supporting the substrate element on the base element with the adhesive-free surface of the substrate element held in engagement with the support surface by the force of magnetic attraction between the base element and the substrate element.

These and other features, advantages and objects of the invention will be apparent from the ensuing description taken in conjunction with the accompanying drawing.

THE DRAWING

Figure 1:
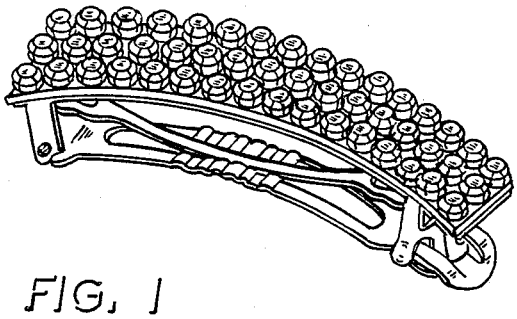
FIG. 1 is a perspective view from above and one side of an article of constructed in accordance with the invention.
Figure 2:
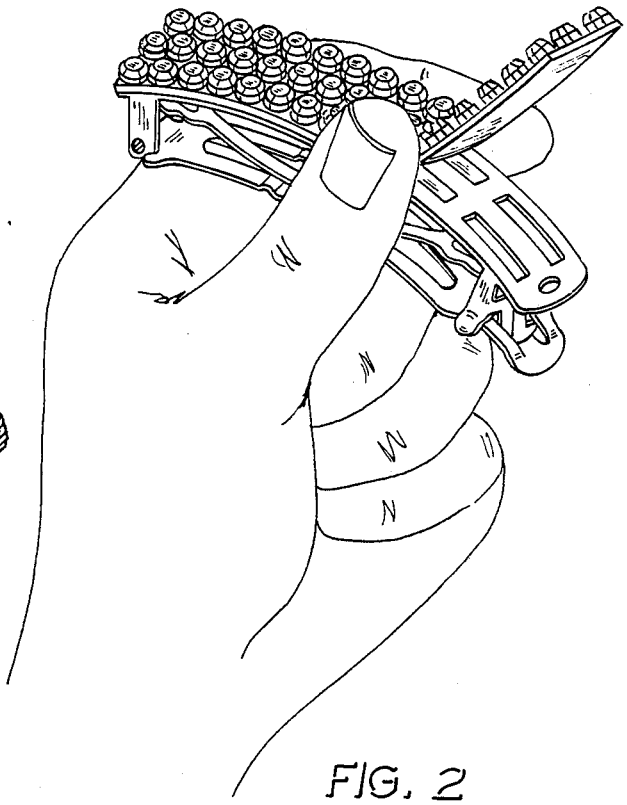
FIG. 2 is a similar perspective view of the article of FIG. 1 but as held in the hand in a manner to exhibit certain features of the article not apparent in FIG. 1.
Figure 3:
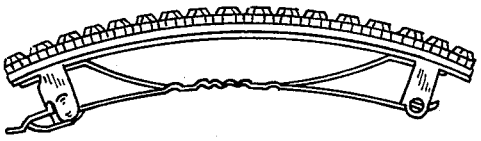
Figure 4:
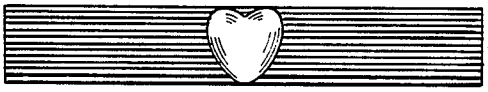
Figure 5:
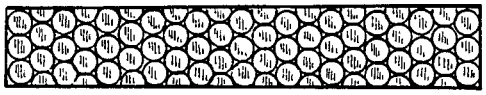
Figure 6:
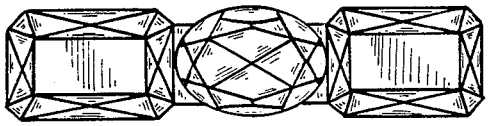

FIG. 5 is an elevational view of the article of FIGS. 1 and 2 side thereof; and FIGS. 4, 5 and 6 are plan views of alternative elements which may respectively be substituted for an element of the article of FIGS. 1, 2 and 3.

THE PREFERRED EMBODIMENT

Referring particularly to FIGS. 1, 2 and 3, there is shown an article of jewelry 10 which includes a base element 12 adapted to be worn on the person. The base element is depicted in the drawing as a conventionally constructed barrette for holding the hair in place in well-known manner, but it may, within the purview of the invention, take any one of a number of forms, such as for example, a bracelet, a finger ring, a brooch, a pendant, a segment of a necklace, a torque, a tie clip, an earring or a cuff link. In any case, base element 12 is preferably formed of a magnetically attractable material which is relatively rigid to form a secure support. Ferrous materials such as steel and other iron alloys are suitable for this purpose, as are synthetic resins impregnated with particles of iron or with iron-containing compounds having magnetic properties. If desired, the base element may be magnetized in well-known manner so that it becomes a permanent magnet.

Base element 12 is provided with a clip or clasp mechanism 14 of such conventional form and function that no further description is required. The base element is also provided with an outer support surface 16 (FIGS. 2 and 3) which, in the conventional barrette, would carry ornamentation permanently affixed thereto.

A substrate element 18 is cut or stamped from a flexible magnetized sheet material. A suitable material for this purpose is distributed in the form of individual rolls of tape under the name "Magnet King" by Jobmaster Corporation, Randallstown, Md. Another tape which appears to be suitable, and a method of making it, are disclosed in U.S. Pat. No. 3,078,183, issued Feb. 19, 1963 to L. W. Karalus. Such a material has the properties of a permanent magnet, and one (20) of its opposed surfaces 20, 22 is coated with adhesive (not shown), preferably of the so-called pressure-sensitive type.

Affixed to the surface 20 by means of the adhesive is ornamentation in the form of faceted stones 24 which, though they may be precious or semiprecious stones, are more commonly rhinestones or the colored equivalent thereof.

In accordance with the invention, substrate element 18 with its ornamentation is supported on base element 12 without any permanent or mechanical connection therebetween. Specifically, the unornamented surface 22 of the substrate element is maintained in engagement with outer support surface 16 of the base element by the force of magnetic attraction, whereby the substrate element may readily be lifted from the base element as indicated in FIG. 2, and removed. Thus it is interchangeable with other like substrate elements bearing ornamentation differing from the ornamentation 24 represented in FIGS. 1, 2 and 3. Examples of such alternative ornamentation are shown in FIGS. 4, 5 and 6. In FIG. 4, substrate element 18 has been covered completely by a flexible sheet material 24*a*which may comprise a woven fabric, a leather, a synthetic resinous material, decorative paper, or the like. Affixed to the material 24*a* by any suitable means is a single heart-shaped stone 24*b*, though the unadorned material 24*a* might itself provide the ornamentation in its entirety.

In FIG. 5, a plurality of sequins 24*c* are adhered to the surface 20. In this instance, the sequins were first applied to surface 20 and then substrate element 18 was cut to shape, thereby assuring that spaces adjacent to the edges of substrate element 18 would be occupied by sequins or portions thereof.

In FIG. 6, three large faceted stones 24*d*, 24*e* and 24*f* have been adhered to surface 20 of substrate element 18.

Though not shown in the drawings, pigments might be applied directly to the outer surface 20 to form the ornamentation. The pigment might be hand-applied by an artist or craftsman or printed upon the substrate in conventional manner.

Though in each of FIGS. 1 to 6, substrate element 18 forms a simple rectangle generally coterminous with support surface 16 of base element 12, the magnetized sheet material may be cut or stamped to any suitable outline dictated by the designer's, manufacturer's or user's imagination, as the case may be.

It is contemplated that the invention be marketed in units, or jewelry sets, each comprising at least one base element such as base element 12 and an assortment of substrate elements 18, the ornamentation borne by each of the substrate elements differing from the ornamentation borne by its fellows.

It will be recognized that the invention may quite suitably take the form of a kit for forming articles of jewelry, the kit comprising at least one base element such as base element 12, a supply of flexible sheet material as described hereinabove, and a supply of decorative means such as the ornamentation 24 and 24*a* to 24*f* represented in the drawing. Preferably, a variety of base elements are provided in the kit, representing various types of jewelry, whereby the user may create ornamentation suitable to be supported on each of the base elements in patterns and materials to suit his or her fancy.

What is claimed is:

1. An article of jewelry comprising a base element adapted to be worn on the person, and a substrate element having opposite surfaces, one of the opposite surfaces bearing ornamentation, the other of the opposite surfaces being unornamented, the base element and the substrate element having magnetically attractable properties and at least one of said elements having the properties of a permanent magnet, the base element having a curved outer support surface adapted to receive the substrate element in engagement with the unornamented surface thereof, whereby the unornamented surface of the substrate element is held in removable engagement with the support surface of the base element by the force of magnetic attraction between the base element and the substrate element, the base element being formed of a relatively rigid ferrous material and the substrate element being formed of a flexible magnetized sheet means for matching the curvature of said base element support surface.

2. An article of jewelry according to claim 1, wherein the ornamentation comprises decorative means adhesively affixed to said one surface.

3. An article of jewelry according to claim 2, wherein the ornamentation comprises at least one stone.

4. An article of jewelry according to claim 2, wherein the ornamentation comprises a decorative flexible sheet material.

5. An article of jewelry according to claim 2, wherein the ornamentation comprises a plurality of sequins.

6. A kit for forming articles of jewelry, comprising at least one base element adapted to be worn on the person, the base element embodying a magnetically attractable material and having a curved outer support surface, a supply of flexible sheet means for matching the curvature of said outer support surface and having the properties of a permanent magnet, and a supply of decorative means, the flexible sheet means having opposite surfaces, one of the opposite surfaces being coated with adhesive, the other of the opposite surfaces being free of adhesive, whereby an article of jewelry may be formed by cutting the flexible sheet means to provide at least one substrate element, affixing at least one of the decorative means to the adhesive-coated surface of the substrate element, shaping the substrate element to match the curved outer support surface, and removably supporting the substrate element on the base element with the adhesive-free surface of the substrate element held in engagement with the curved support surface by the force of magnetic attraction between the base element and the substrate element.

7. A kit according to claim 6, wherein the decorative means include at least one stone.

8. A kit according to claim 6, wherein the decorative means include a decorative flexible sheet material.

9. A kit according to claim 6, wherein the decorative means include a plurality of sequins.

10. A kit according to claim 6, wherein the base element is a barrette.

* * * * *